US005993028A

United States Patent [19]

Ong

[11] Patent Number: 5,993,028

[45] Date of Patent: Nov. 30, 1999

[54] LAMP HOLDER

[75] Inventor: Chao-Ching Ong, Hsinchuang, Taiwan

[73] Assignee: Hung-Yueh Chang, Taipei Hsien, Taiwan

[21] Appl. No.: 09/057,354

[22] Filed: Apr. 8, 1998

[51] Int. Cl.[6] ..... F21V 7/00

[52] U.S. Cl. ..... 362/307; 362/310; 362/226

[58] Field of Search ..... 362/307, 310, 362/226, 351, 308

[56] References Cited

U.S. PATENT DOCUMENTS 4,754,382 6/1988 Furlan ..... 362/310

4,819,142 4/1989 Lothamer ..... 362/226

5,758,958 6/1998 Chen ..... 362/307

*Primary Examiner*—Thomas M. Sember

*Attorney, Agent, or Firm*—Pro-Techtor International Services

[57] ABSTRACT

A lamp holder includes a bowl-like lampshade having a top center hole, a glass cover covered on the opened bottom side of the lampshade and detachably secured thereto by clamps, a hopper-like mount having a flanged neck fastened to the top center hole of the lampshade and an outwardly extended top mounting flange, a socket cap detachably fastened to top mounting flange of the mount by screws to hold a lamp socket on the inside and a lamp bulb in the lamp socket within the lampshade.

1 Claim, 6 Drawing Sheets

LAMP HOLDER

BACKGROUND OF THE INVENTION

The present invention relates to a lamp holder, and more particularly to such a lamp holder which can be conveniently opened for the installation of the bulb.

FIG. 1 shows a lamp holder according to the prior art. This structure of lamp holder comprises a lampshade A having a plurality of springy retainer strips D riveted thereto at the periphery, a glass cover E covered on the lampshade A at the bottom side and secured in place by the springy retainer strips D, and a lamp socket assembly B fixedly fastened to the lampshade A at the top and holding a lamp tube C within the lampshade A. This structure of lamp holder is still not satisfactory in function. When replacing the lamp bulb C, the cover E must be disconnected from the lampshade A. When disconnecting the cover E from the lampshade A, the retainer strips D must be pulled outwards and stretched. When pulling the retainer strips D, the fingers may easily be injured by sharp edges of the retainer strips D or edges at the lampshade A around the retainer strips D. Frequently stretching the retainer strips D may cause the retainer strips D to deform permanently and to lose spring power, thereby causing the cover E unable to be firmly secured to the lampshade A. Furthermore, because the lamp socket assembly B is fixedly fastened to the lampshade A at the top, the lampshade A cannot be disconnected from the lampshade A for a repair work. Because the lamp socket assembly B is not detachable, it is inconvenient to disconnect the lamp bulb C from the lamp socket assembly B or to clean the inside of the lamp socket assembly B.

SUMMARY OF THE INVENTION

According to one embodiment of the present invention, the lamp holder comprises a lampshade, the lampshade having a center through hole, a mount fastened to the lampshade, a glass cover covered on the lampshade, the cover having a peripheral mounting groove, a plurality of clamps that secure the cover and the lampshade together, a socket cap mounted on the mount, a lamp socket fastened to the socket cap on the inside and holding a lamp bulb in the lampshade, wherein the lampshade is a hollow, rounded, bowl-like member having a peripheral mounting groove; the clamps each have a first clamping portion clamped on the peripheral mounting groove on the lampshade, a second clamping portion clamped on the peripheral mounting groove on the cover, and a finger strip integral with the second clamping portion for the holding of the hand; the mount comprises a hollow, hopper-like body having a neck downwardly extended from a bottom side thereof and inserted into the center through hole on the lampshade, a bottom coupling flange integral with the neck and fastened to a flanged peripheral portion of the center through hole of the lampshade, a top mounting flange horizontally outwardly extended from a top side thereof for holding the socket cap, and a plurality screw holes equiangularly spaced at the top mounting flange; the socket cap comprises a plurality of through holes at a top side thereof to which the lamp socket is fastened by screws, and a plurality of mounting holes equiangularly spaced around the border at a bottom side thereof respectively fastened to the screw holes on the top mounting flange of the mount. When replacing the lamp bulb, the cover can be conveniently disconnected from the lampshade y pulling the finger strips of the clamps to disengage the second clamping portions of the clamps from the peripheral mounting groove on the cover. Furthermore, when repairing the lamp socket, the socket cap can be conveniently disconnected from the mount by removing the screws from the socket cap and the top mounting flange of the mount.

DETAILED DESCRIPTION OF THE PREFERRED EMBODIMENT

Figure 1:
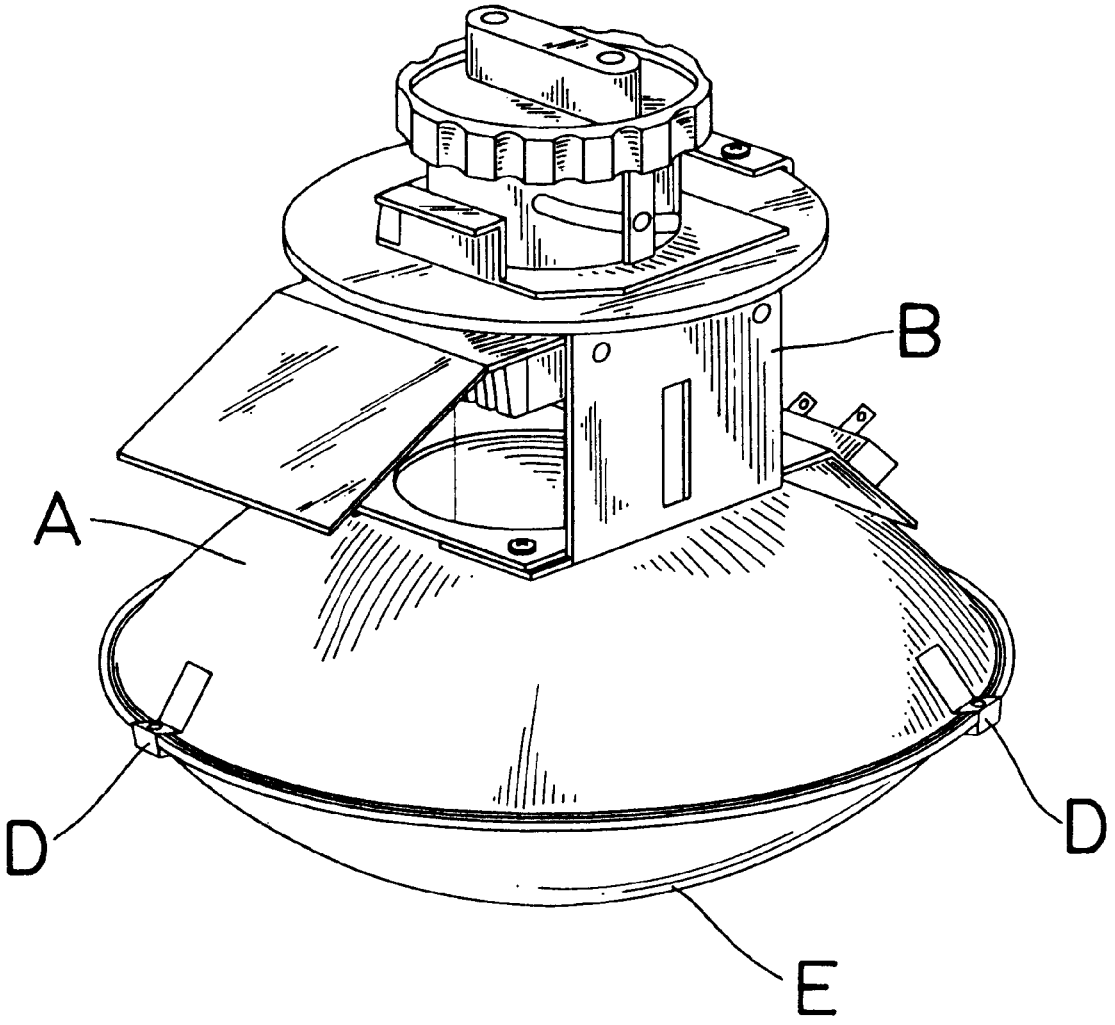
Fig. 1 PRIOR ART
FIG. 1 is a perspective view of a lamp holder according to the prior art.
Figure 2:
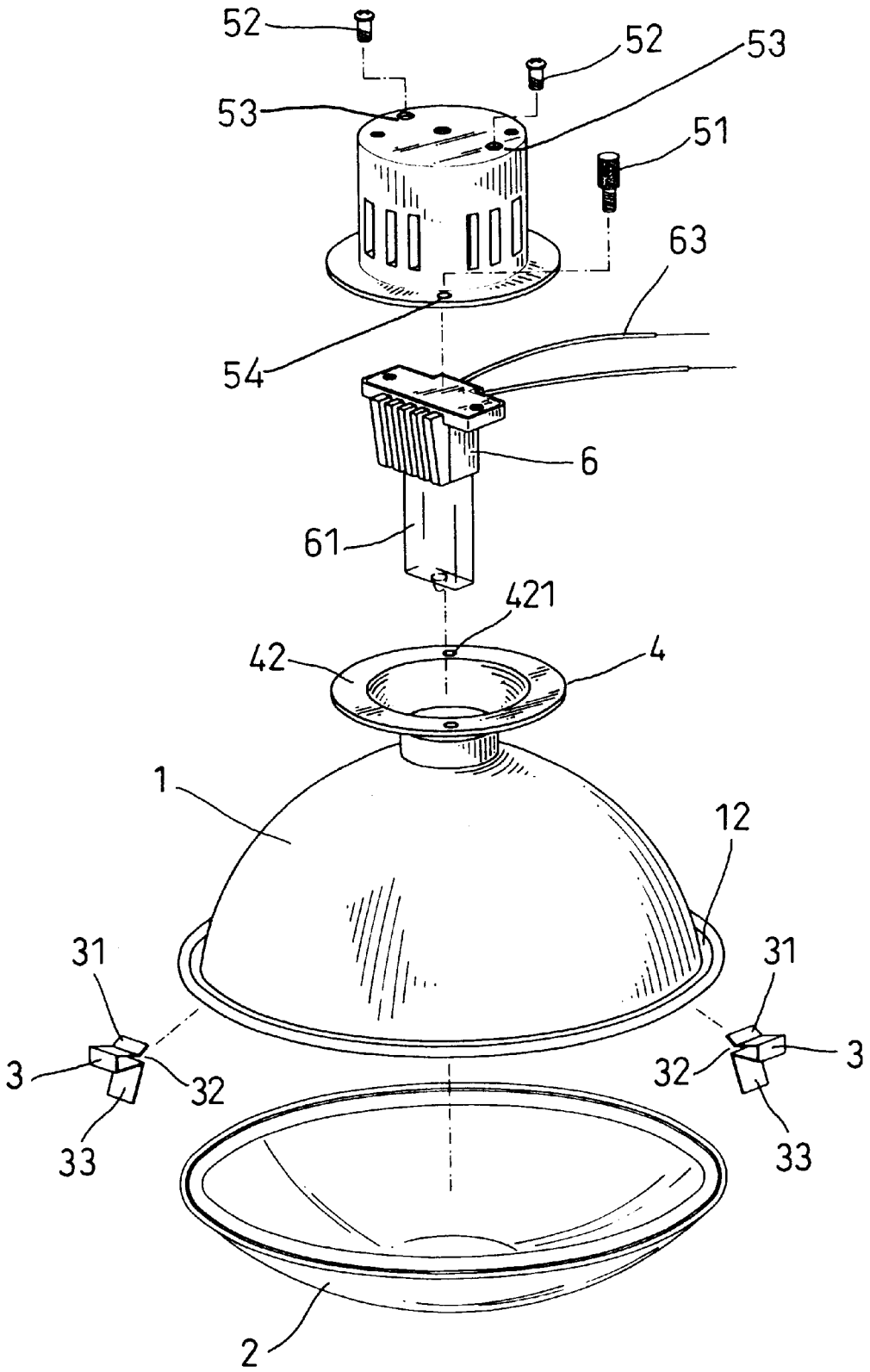
FIG. 2 is an exploded view of a lamp holder according to the present invention.
Figure 3:
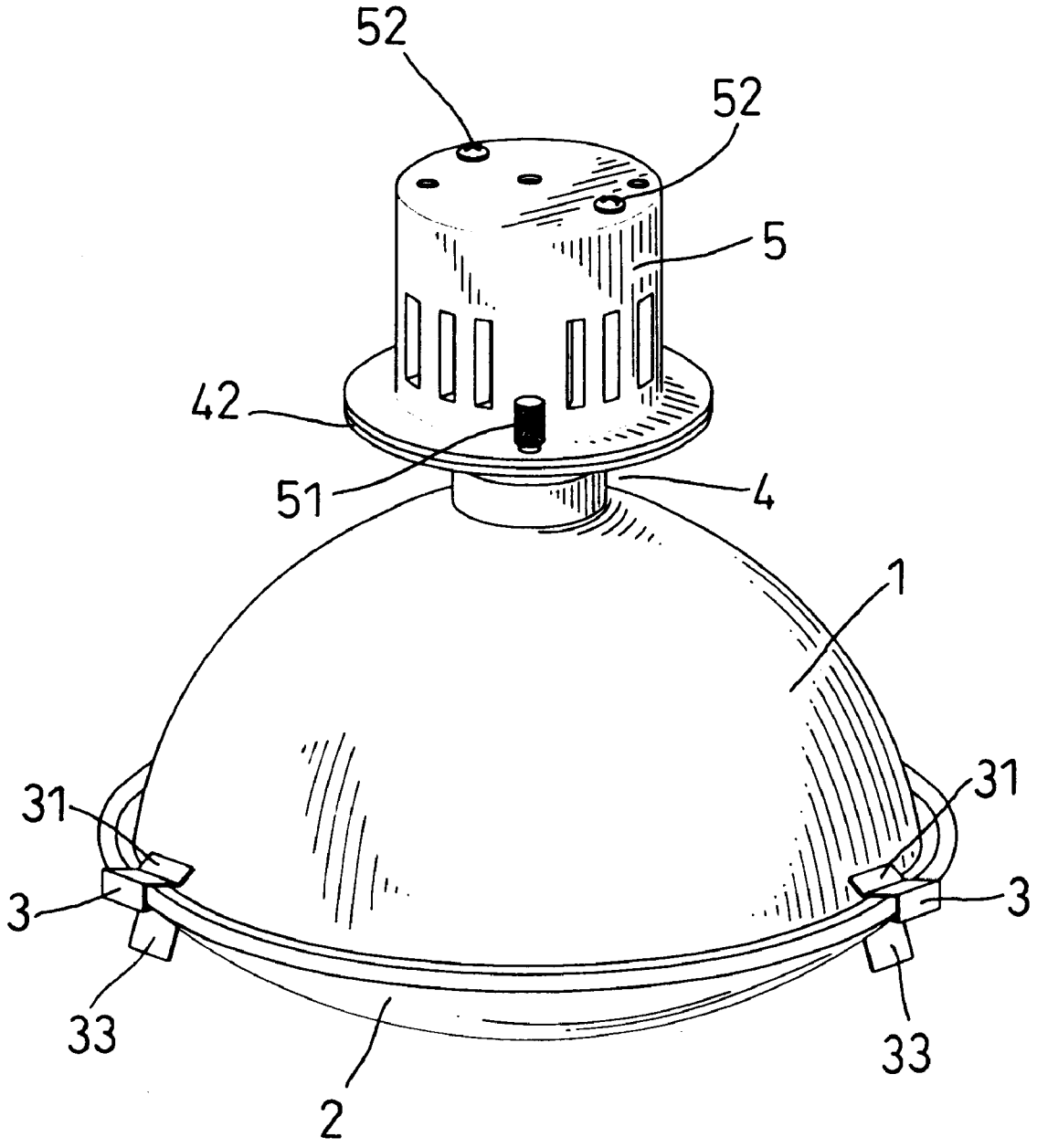
FIG. 3 is a perspective assembly view of the lamp holder shown in FIG. 2.
Figure 4:
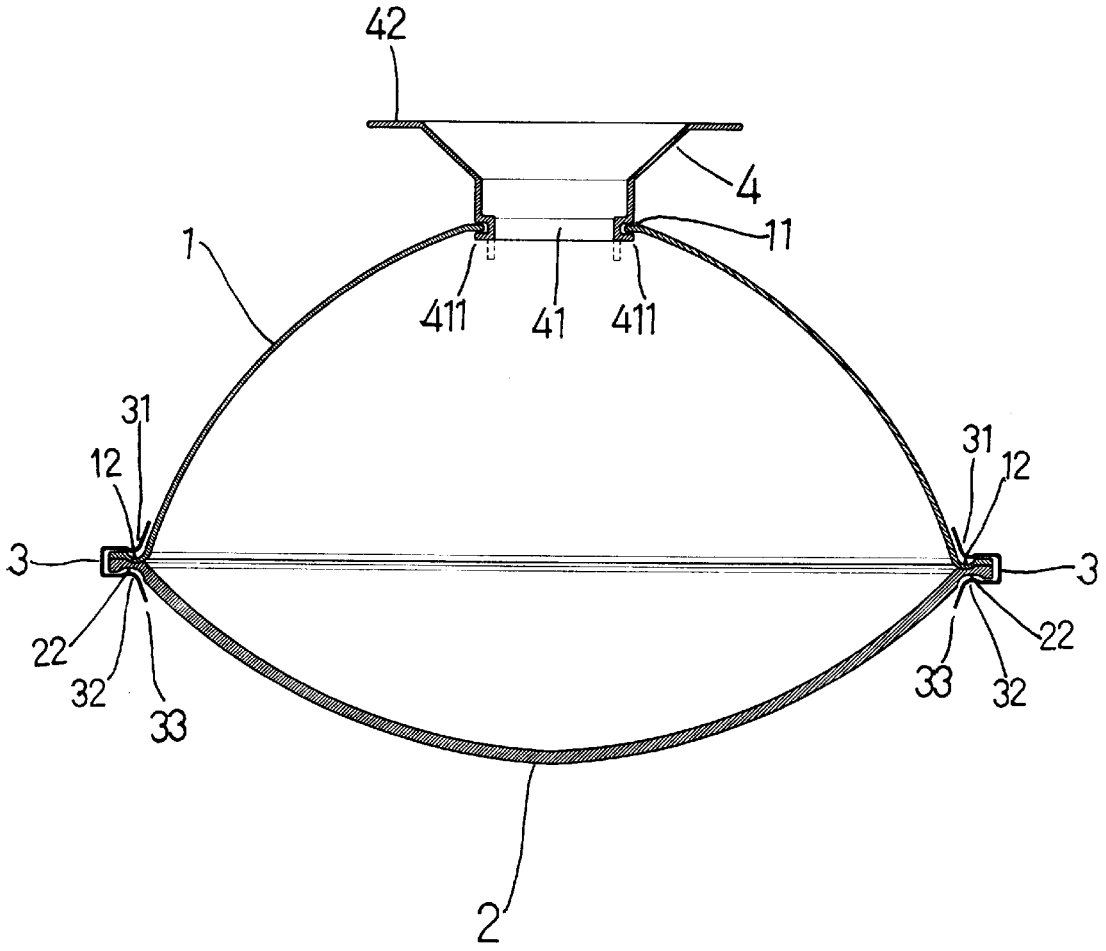
FIG. 4 is a partial view in section of the present invention, showing the connection between the mount and the lampshade and the connection between the lampshade and the cover.

Referring to FIGS. from 2 to 4, a lamp holder in accordance with the present invention is generally comprised of a lampshade 1, a glass cover 2, a plurality of clamps 3, a mount 4, a socket cap 5, and a lamp socket 6 holding a lamp bulb 61.

The lampshade 1 is a hollow, rounded, bowl-like member having a center through hole 11 through which the lamp bulb 61 is inserted into the inside space of the lampshade 1, and a peripheral mounting groove 12. The glass cover 2 is covered on the lampshade 1, having a peripheral mounting groove 22 corresponding to the peripheral mounting groove 12 on the lampshade 1. The clamps 3 are respectively fastened to the lampshade 1 and the glass cover 2 to secure the lampshade 1 and the glass cover 2 together. Each clamp 3 comprises a first clamping portion 31 clamped on the peripheral mounting groove 12 on the lampshade 1, a second clamping portion 32 clamped on the peripheral mounting groove 22 on the glass cover 2, and a finger strip 33 integral with the second clamping portion 32 for the holding of the hand. The mount 4 is a hollow, hopper-like member having a neck 41 downwardly extended from the bottom side thereof and inserted into the center through hole 11 on the lampshade 1, a bottom coupling flange 411 integral with the bottom end of the neck 41, a top mounting flange 42 horizontally outwardly extended from the top side thereof, and a plurality of screw holes 421 equiangularly spaced at the top mounting flange 42. The socket cap 5 is covered on the mount 4 to hold the lamp socket 6 on the inside, having a plurality of through holes 53 at the top side thereof, and a plurality of mounting holes 54 equiangularly spaced around the border at the bottom side thereof. The socket cap 5 is mounted on the mount 4 with its mounting holes 54 respectively fastened to the screw holes 421 on the top mounting flange 42 of the mount 4 by screws 51. The lamp socket 6 is mounted inside the socket cap 5 and fastened to the through holes 53 on the socket cap 5 by screws 52.

Referring to FIGS. from 2 to 4 again, after the neck 41 of the mount 4 has been inserted into the center through hole 11 on the lampshade 1, the bottom coupling flange 411 of the mount 4 is bent inwards and fastened to the flanged periphery of the center through hole 11, and then the glass cover 2 is covered on the lampshade 1 and secured thereto by the clamps 3, and then the socket cap 5 is fastened to the mount 4 to hold the lamp bulb 61 in the lamp socket 6 inside the lampshade 1. After installation, the lead-out wires 63 of the lamp socket 6 are connected to power supply.

Figure 5:
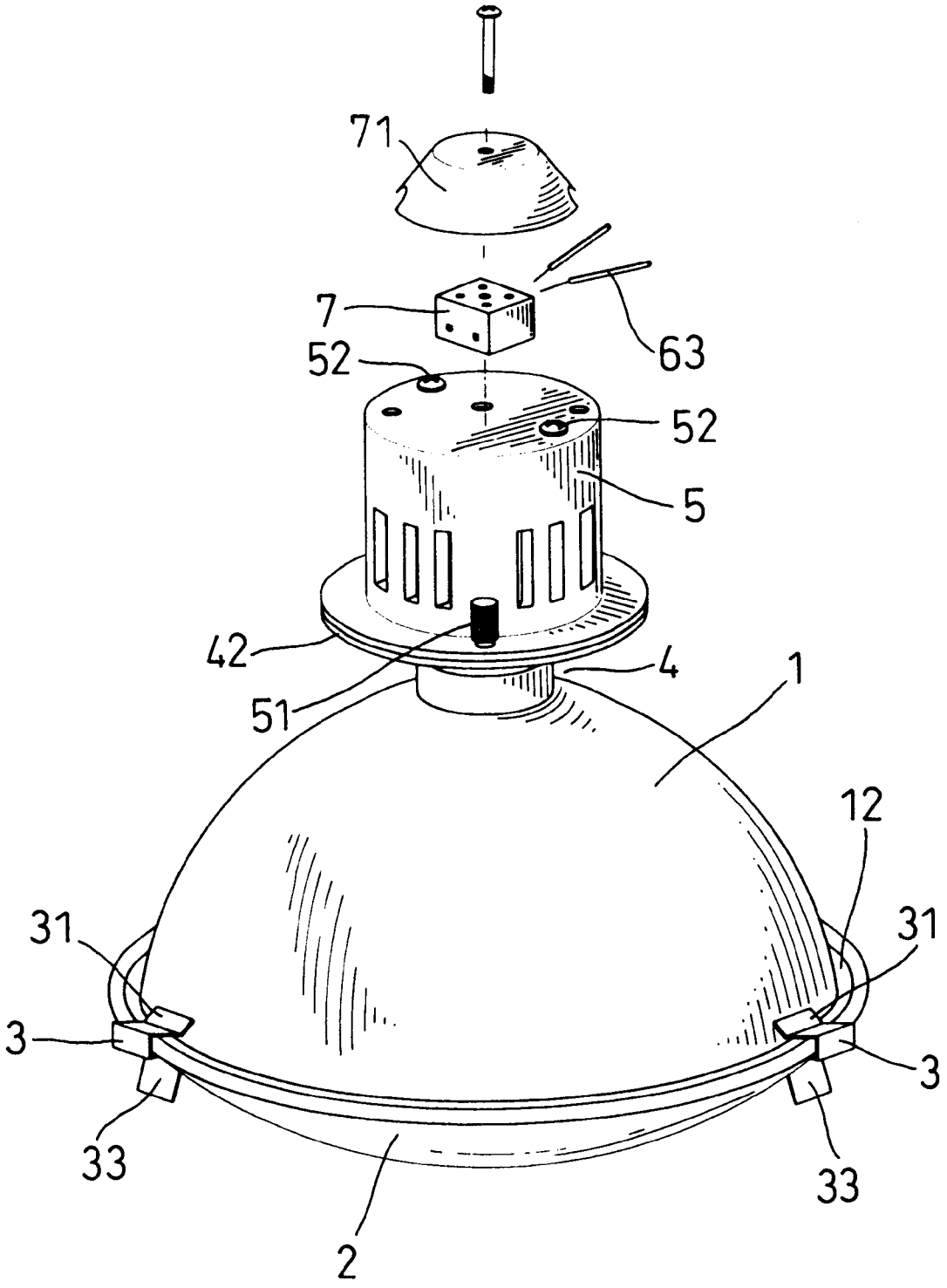
FIG. 5 is an exploded view of an alternate form of the lamp holder according to the present invention.

FIG. 5 shows an alternate form of the present invention, in which a junction box 7 is mounted on the top side of the socket cap 5 through which the lamp socket lead-out wires 63 are connected to external power supply, and a cover 71 is covered on the socket cap 5 over the junction box 7 for protection.

Figure 6:
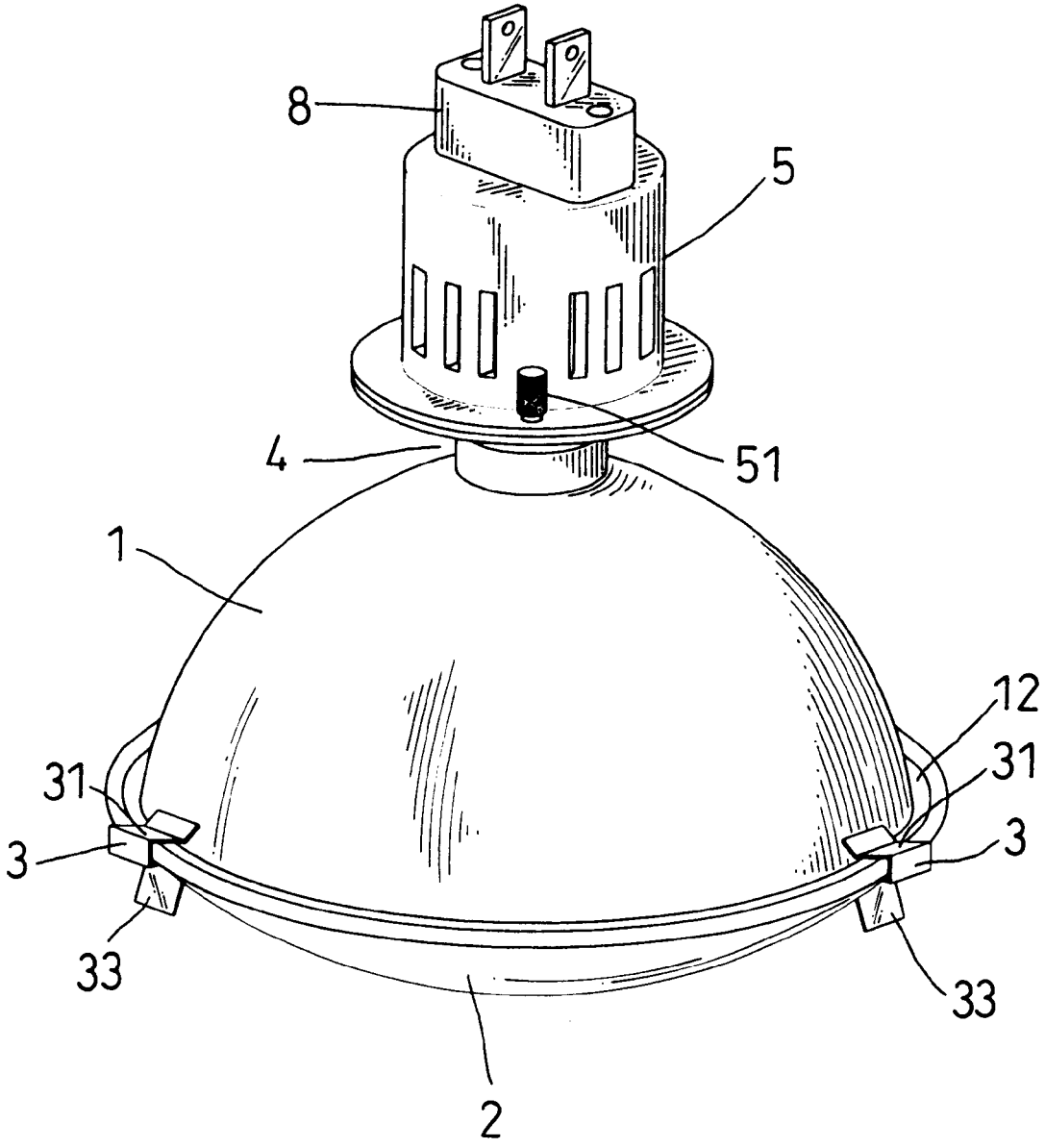
FIG. 6 is a perspective view of another alternate form of the lamp holder according to the present invention.

FIG. 6 shows another alternate form of the present invention, in which an electric plug 8 is mounted on the top side of the socket cap 5 for connection to an external power supply outlet.

It is to be understood that the drawings are designed for purposes of illustration only, and are not intended as a definition of the limits and scope of the invention disclosed.

What the invention claimed is:

1. A lamp holder comprising a lampshade, said lampshade having a center through hole, a mount fastened to said lampshade, a cover that admits light covered on said lampshade, said cover having a peripheral mounting groove, a plurality of clamps that secure said cover and said lampshade together, a socket cap mounted on said mount, a lamp socket fastened to said socket cap on an inside and holding a lamp bulb in said lampshade, wherein:

said lampshade is a hollow, rounded, bowl-like member having a peripheral mounting groove;

said clamps each have a first clamping portion clamped on the peripheral mounting groove on said lampshade, a second clamping portion clamped on the peripheral mounting groove on said cover, and a finger strip integral with said second clamping portion for the holding of a user's hand;

said mount comprises a hollow, hopper-like body having a neck downwardly extended from a bottom side thereof and inserted into a center through hole on said lampshade, a bottom coupling flange integral with said neck and fastened to a flanged peripheral portion of the center through hole of said lampshade, a top mounting flange horizontally outwardly extended from a top side thereof for holding said socket cap, and a plurality screw holes equiangularly spaced at said top mounting flange;

said socket cap comprises a plurality of through holes at a top side thereof to which said lamp socket is fastened by screws, and a plurality of mounting holes equiangularly spaced around a border at a bottom side thereof respectively fastened to the screw holes on the top mounting flange of said mount.

* * * * *